United States Patent [19]

Kitagawa

[11] Patent Number: 4,613,241

[45] Date of Patent: Sep. 23, 1986

[54] PRINTING MECHANISM FOR DOT MATRIX PRINTERS

[75] Inventor: Kunio Kitagawa, Tokyo, Japan

[73] Assignee: NEC Corporation, Tokyo, Japan

[21] Appl. No.: 688,131

[22] Filed: Jan. 2, 1985

[30] Foreign Application Priority Data

Jan. 5, 1984 [JP] Japan ..... 59-429
Jun. 11, 1984 [JP] Japan ..... 59-120190

[51] Int. Cl.[4] ..... B41J 3/12; B41J 23/24

[52] U.S. Cl. ..... 400/121; 400/124; 400/176; 400/179; 101/93.05

[58] Field of Search ..... 400/121, 124, 176, 179, 400/118; 101/93.04, 93.05; 346/140 PD

[56] References Cited

U.S. PATENT DOCUMENTS 3,405,793 10/1968 Stuiber ..... 400/157.3 X
3,640,214 2/1972 Scheinhutte ..... 101/45
4,021,818 5/1977 Van Vloten ..... 346/140 PD
4,027,762 6/1977 Nakauchi ..... 400/176 X
4,272,200 6/1981 Hehl ..... 400/124
4,503,445 3/1985 Fridman ..... 400/121 X

*Primary Examiner*—Paul T. Sewell
*Attorney, Agent, or Firm*—Sughrue, Mion, Zinn, Macpeak, and Seas

[57] ABSTRACT

A dot-type printer of the type using printing pins or wires is improved by employing a driving system which includes a variable-volume sealed container enclosing a pressure transmitting medium. Electrodes are disposed in the medium and are closely spaced such that the application of a high voltage will cause arc discharge across the same. The discharge energy applied to the medium causes an expansion of the medium, which in turn causes an expansion of the sealed container. The printing pins or wires are abutted against a movable membrane or bellows portion of the container, so that container expansion effects linear movement of the pins or wires.

24 Claims, 15 Drawing Figures

FIG 2
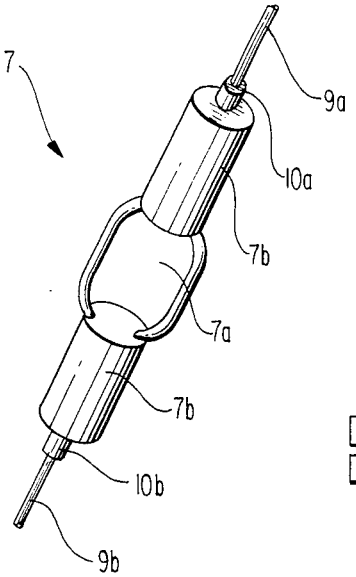
FIG 3
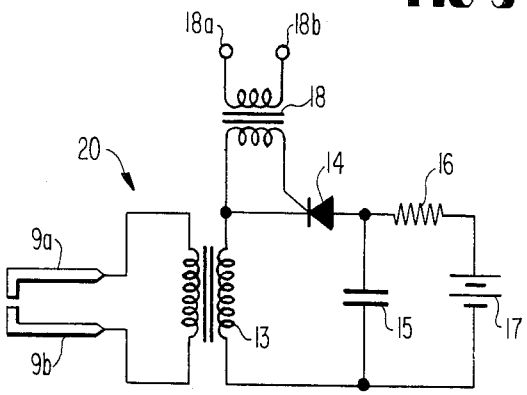
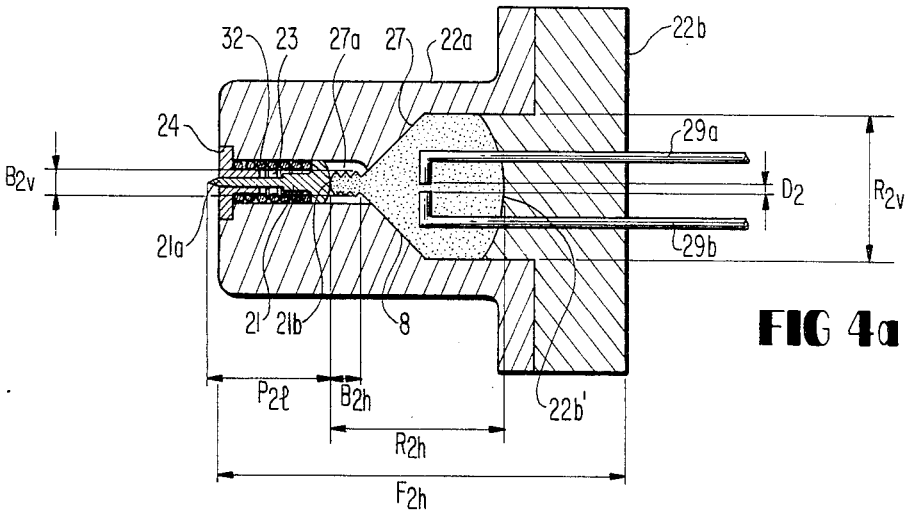
FIG 4a
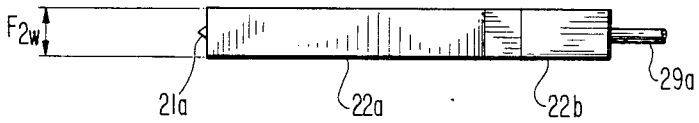
FIG 4b

FIG 5a
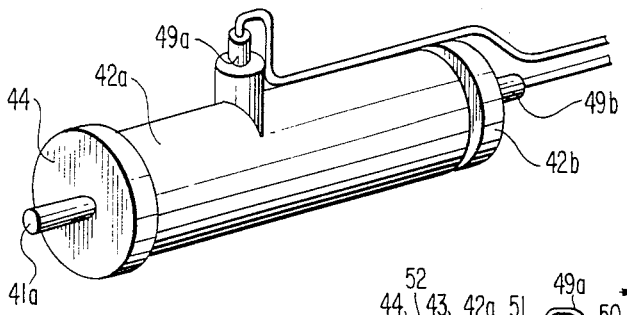
FIG 5b
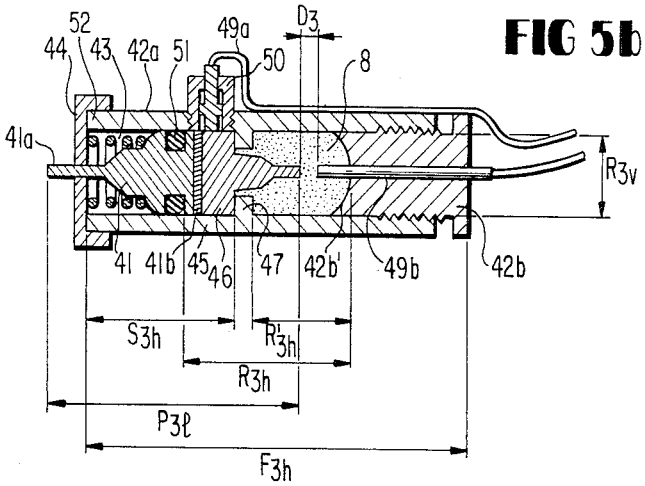
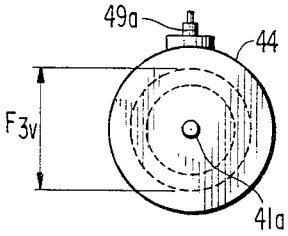
FIG 5c
FIG 6a
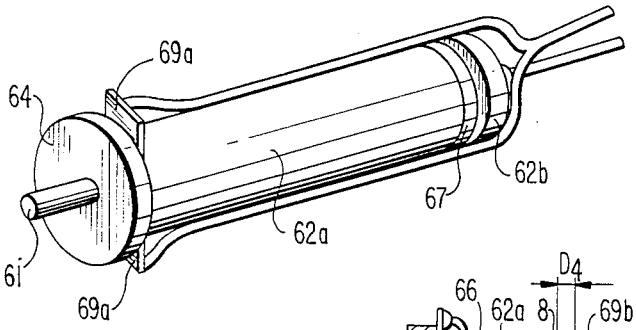
FIG 6b
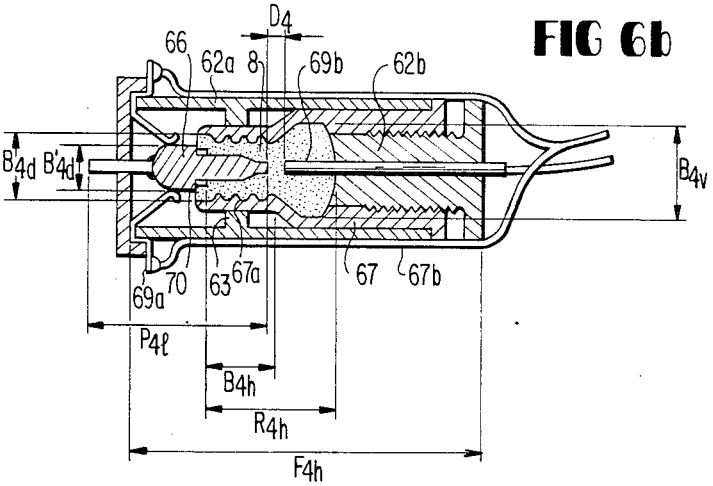
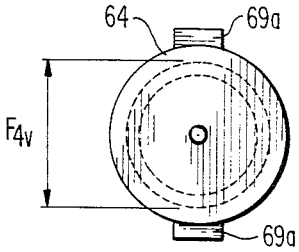
FIG 6c

PRINTING MECHANISM FOR DOT MATRIX PRINTERS

BACKGROUND OF THE INVENTION

The present invention relates to a dot matrix printer, and more particularly to an impact type printing head for use in the dot matrix printer.

A printer of this kind has a plurality of selectively driven printing needles or printing wires for printing figures and letters in the form of dot matrixes on paper. Presently, most of the printers of this kind employ electromagnets for driving the printing needles or wires. For example, a line printer disclosed in U.S. Pat. No. 3,941,051 comprises plate springs each having a printing needle, permanent magnets disposed at the lower rear of the plate springs, and electromagnets at the upper rear of the plate springs. The plate springs are bent by the attracting magnetic force of the permanent magnet. When one of the electromagnets is energized, the magnetic force of the permanent magnet is offset, and the printing needle is projected toward a platen by the resilient force of the plate spring. However, this conventional printer requires an excessively large driving current due to the heat generated in the coil of the electromagnets, eddy currents and a hysteresis loss occurring in the yoke and armature. Therefore, the current capacity of a driving circuit for the electromagnets and the capacity of the power source are necessarily large. This causes the printer to be large and expensive. Furthermore, the use of electromagnets and permanent magnets attached to the reciprocating printing mechanism produces a heavy printing mechanism. Therefore, high printing speeds cannot easily be realized.

SUMMARY OF THE INVENTION

Therefore, an object of the present invention is to provide a compact and lightweight printing mechanism.

Another object of the present invention is to provide a printing mechanism which can drive the printing pins at a high-speed.

A still another object of the present invention is to provide a novel printing mechanism which drives the printing pins by means of the expansion of a pressure transmitting medium.

According to the present invention, there is provided a printing mechanism comprising: a printing pin having an impacting surface at its front end; a holder for slidably supporting the printing pin for movement in the impacting direction; a hermetically sealed expansible container disposed in the rear end of the printing pin so as to come into contact with the same; a pressure transmitting medium filled within the hermetically sealed container; and two electrodes for applying a high voltage to the pressure transmitting medium provided within the hermetically sealed container.

BRIEF DESCRIPTION OF THE DRAWINGS

The above-mentioned and other objects, features and advantages of the present invention will be better understood from the following detailed description of preferred embodiments of the present invention taken in conjunction with the accompanying drawings, wherein:

FIG. 2 is a perspective view of a tube used in the printing mechanism shown in FIGS. 1(*a*), 1(*b*) and 1(*c*).

FIG. 3 is a circuit diagram showing the driving circuit of a printing mechanism;

FIGS. 4(*a*) and 4(*b*) are a sectional view and a top plan view of a printing mechanism according to a second embodiment of the present invention;

FIGS. 5(*a*), 5(*b*), and 5(*c*) are a perspective view, a cross-sectional view, and a front view of a printing mechanism according to a third embodiment of the present invention, respectively;

FIGS. 6(*a*), 6(*b*), and 6(*c*) are a perspective view, a cross-sectional view, and a front view of a printing mechanism according to a fourth embodiment of the present invention, respectively;

DESCRIPTION OF THE PREFERRED EMBODIMENTS

Figure 1A:
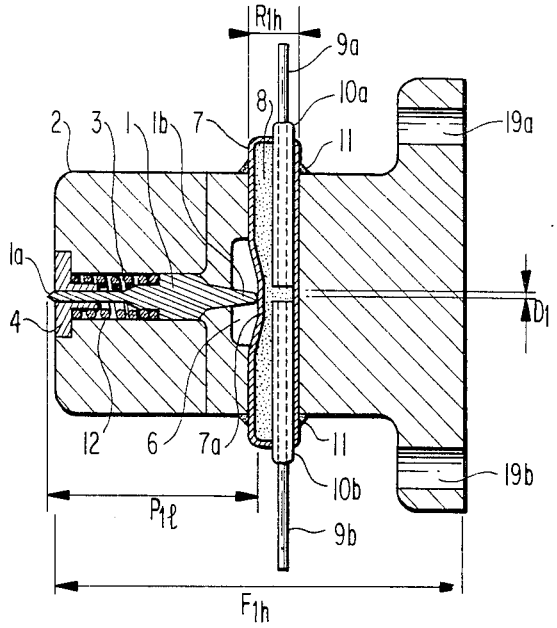
FIGS. 1(*a*), 1(*b*), and 1(*c*) are a sectional view, a cross-sectional view taken along the line Y—Y, and a front view of a printing mechanism according to a first embodiment of the present invention, respectively.
Figure 1B:
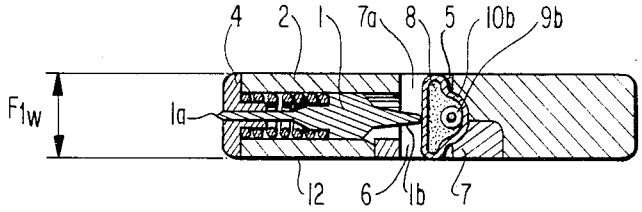
Figure 1C:
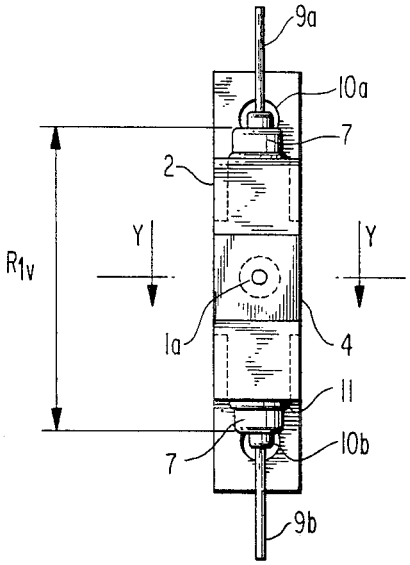

Referring to FIGS. 1(*a*), 1(*b*), and 1(*c*), a printing pin 1 is provided inside the guide hole 3 of a frame 2 and is slidable in the lateral direction in FIG. 1(*a*). The printing pin 1 is made of cemented carbon tungsten and the frame 2 is made of fine ceramics containing materials such as alumina ($Al_2O_3$). The front end 1*a* of the printing pin 1 is further slidably held by an end guide 4. The end guide 4 is made of a hard material such as alumina ($Al_2O_3$), ruby, or the like so as not to be abraded by the sliding of the printing pin 1.

In the central portion of the frame 2, hollow portions 5 and 6 are formed in the vertical direction of FIGS. 1(*a*) and 1(*b*). An elastic tube 7 is disposed inside the hollow portion 5. The tube 7 is secured to the frame 2 by means of an adhesive material 11. A pressure transmitting medium 8 and two electrodes 9*a* and 9*b* are hermetically sealed into the tube 7. The pressure transmitting medium 8 is an inactive liquid or gas having electrical insulative properties, such as transformer oil, air, or the like. The electrodes 9*a* and 9*b* are covered with insulating materials 10*a* and 10*b* except for their ends positioned inside the tube. The ends of the electrodes 9*a* and 9*b* are spaced by a distance suitable for electrical discharge, for instance, the distance $D_1=0.5$ mm. The tube 7 is adhered to the inner wall of the hollow portion 5 except for a pressing portion 7*a* formed at its center portion.

The printing pin 1 is urged in the rightward direction in FIG. 1(*a*) in the guide hole 3 by means of a spring 12. Accordingly, the spring 12 enables the rear end 1*b* of the printing pin 1 to come into contact with the pressing portion 7*a* of the tube 7. Incidentally, screw holes 19*a* and 19*b* for installing this mechanism are formed at the rear of the frame 2.

In the printing mechanism according to a first embodiment, the length $F_{1h}$ of the frame 2 is 20.0 mm, and the width $F_{1w}$ is 2.54 mm (0.1 inch). The length $P_{1l}$ of the printing pin 1 is 8.0 mm. Additionally, the longitudinal length $R_{1v}$ of the tube 7 is 11.0 mm, the diameter $R_{1h}$ of the cylindrically-shaped upper and lower portions 7*b* is 2.0 mm.

Referring to FIG. 2, with respect to the tube 7, the upper and lower portions 7*b* to be secured to the inner wall of the hollow portion 5 of the frame 2 are cylindrical, while the pressing portion 7*a* is flat. Furthermore, the thickness of the pressing portion 7*a* of the tube 7 is thinner than the thickness of the upper and lower portions 7*b*. That is, the thickness of the upper and lower portions 7*b* is about 0.2 mm, while the thickness of the pressing portion 7*a* is about 0.1 mm. Accordingly, a change in the capacity of the pressure transmitting medium 8 is concentrated on the pressing portion 7*a*. Incidentally, stainless spring steel, phosphor spring bronze, or urethane rubber can be selected as the preferable material for the tube 7.

FIG. 3 shows a driving circuit 20 of the printing pin 1. The electrodes 9*a* and 9*b* are connected to the secondary winding of a boosting transformer 13. The primary winding of the boosting transformer 13 is connected to a capacitor 15 via a switching element 14. The capacitor 15 accumulates the charge from a DC power supply 17 via a resistor 16. The switching element 14 is connected to a transformer 18, and effects the switching operation by means of a control pulse applied to terminals 18*a* and 18*b*. Accordingly, the charge accumulated in the capacitor 15 flows to the primary winding of the boosting transformer 13, in dependence upon the switching action of the switching element 14. This current is boosted by the transformer 13, and a high voltage is applied to the electrodes 9*a* and 9*b*. Thus, discharge takes place between the electrodes 9*a* and 9*b*.

In order to cause discharge between the electrodes 9*a* and 9*b*, the DC power supply 17 is set to 200 V, the resistor 16 is set to 200 to 300 Ω, and the capacitor 15 is set to 2–3 μF. Also, the winding ratio of the boosting transformer 13 is set from 10:1 to 20:1. In this case, the potential difference between the electrodes 9*a* and 9*b* is 2–4 kV, and sufficient discharge takes place between the electrodes 9*a* and 9*b*.

When the discharge takes place between the electrodes 9*a* and 9*b* inside the tube 7, the pressure transmitting medium 8 quickly expands due to the discharge energy. The elastic tube 7 also expands outwardly due to the expansion of the pressure transmitting medium 8. The greatest expanding deflection of the tube 7 is obtained at the thin pressing portion 7*a*. Accordingly, the pressing portion 7*a* presses the rear end 1*b* of the printing pin 1. Thus, the printing pin 1 moves in the left direction in FIG. 1(*a*) against the biasing force of the spring 12, and the end 1*a* protrudes leftwardly. A moving distance of 0.3 to 0.5 mm is obtained as the stroke of the printing pin 1.

Since the discharge between the electrodes 9*a* and 9*b* disappears within a very short interval, the expansion of the pressure transmitting medium 8 is also completed in a very short period. Therefore, the pressure of the transmitting medium 8 declines suddenly, and the tube 7 resumes its original configuration. Additionally, the printing pin 1 also returns to its original position by means of the spring 12.

Since the discharge between the electrodes 9*a* and 9*b* is synchronized with a control pulse applied to the terminals 18*a* and 18*b*, the printing timing of the printing pin 1 can be controlled by means of this control pulse. Incidentally, about 10 μS is selected as the active period (printing time) of the control pulse.

In general, the speed of increase of pressure within a hermetically sealed container is proportional to the energy released in the container in a given time, and is inversely proportional to the square root of the internal volume of the sealed container. Accordingly, it is possible to adjust the impacting force of the printing pin 1 by means of the released energy determined by the capacity of the resistor 16 and capacitor 15 in the driving circuit 20 as well as the internal volume of the sealed container (tube 7). In addition, the appropriate switching period of the printing pin 1 can be obtained by adjusting the time constants of the resistor 16 and the capacitor 15.

The printing mechanism described above has a high printing speed, consumes little energy, and is compact since the mechanism drives only the light-weight printing pin 1.

FIGS. 4(*a*) and 4(*b*) illustrate a second embodiment of the present invention. A printing pin 21 is slidably provided inside the guide hole 23 of a front frame 22*a*. The front end 21*a* of the printing pin 21 is further held by an end guide 24. A sector-shaped bore is formed continuously to the guide hole 23 inside the front frame 22*a*. An elastic container 27 is adhered to the inner wall of the bore. A bellows 27*a* is formed at the front end of the elastic container 27, which is inserted into the guide hole 23. The pressure transmitting medium 8 is filled in the elastic container 27, and sealed by a rear frame 22*b*. The rear frame 22*b* is inserted into the front frame 22*a* from the rightward direction. In other words, a hermetically sealed space is formed by the elastic container 27 and the recessed surface 22*b*′ of the frame 22*b*. Moreover, a pilot pressure is given to the pressure transmitting medium 8.

The two electrodes 29*a* and 29*b* are secured to the rear frame 22*b*. As the rear frame 22*b* is inserted into the front frame 22*a*, the front end portions of the electrodes 29*a* and 29*b* are disposed practically in the center of the pressure transmitting medium 8. Incidentally, the electrodes 29*a* and 29*b* and the rear frame 22*b* are electrically insulated.

The printing pin 21 is urged rightwardly by a spring 32. The spring 32 enables the rear end 21*b* of the printing pin 21 to come into contact with the bellows 27*a*.

In the printing mechanism according to the second embodiment, the length $F_{2h}$ of the combined frame including the front and rear frames 22*a* and 22*b* is 25.0 mm, and the width $F_{2w}$, 2.54 mm. The length $P_{2l}$ of the printing pin 21 is 6.0 mm. The length $R_{2h}$ of the hermetically sealed space formed by the container 27 and the recessed surface 22*b*′ is 12.0 mm, and the maximum diameter $R_{2v}$ of the hermetically sealed space is 10.0 mm. The length $B_{2h}$ of the bellows 27*a* at the time of shrinkage is 5.0 mm, and the maximum diameter $B_{2v}$ of the bellows is 3.0 mm. The capacity of the hermetically sealed space is about 0.13 $cm^2$. Furthermore, the distance $D_2$ between the end portions of the electrodes 29*a* and 29*b* is set to 0.5 mm.

The electrodes 29*a* and 29*b* are connected to the driving circuit 20 shown in FIG. 3, as the same as the first embodiment. When discharge is caused between the electrodes 29*a* and 29*b*, the pressure transmitting medium 8 expands. Due to this expansion, the bellows 27*a* of the elastic container 27 expands leftwardly. Accordingly, the bellows 27*a* presses the rear end 21*b* of the printing pin 21, and the printing pin 21 projects leftwardly. The stroke of the printing pin 21 is about 0.3 to 0.5 mm.

When the discharge between the electrodes 29*a* and 29*b* stops, the pressure of the container 27 instantly decreases. Then, the bellows 27*a* shrinks to its initial configuration. Therefore, the printing pin 21 returns leftwardly by means of the restoring force of spring 32. Similarly to the first embodiment, the printing timing of the printing pin 21 is controlled by a control pulse applied to the terminals 18*a* and 18*b* of the driving circuit 20.

In the second embodiment, since the printing mechanism drives only the printing pin 21, the printing operation can repeatedly be carried out at a high speed using a compact and lightweight mechanism.

FIGS. 5(*a*), 5(*b*), and 5(*c*) show a third embodiment of the present invention. A printing pin 41 is slidably held in the lateral direction in FIG. 5(*b*) inside the inner cylinder 43 of a cylindrically-shaped front frame 42*a*. The front end 41*a* of the printing pin 41 is further held by a guide 44. A movable electrode 46 is secured to the rear end 41*b* of the printing pin 41 via an insulator 45. The printing pin 41 and the movable electrode 46 slide integrally inside the inner cylinder 43. The insulator 45 is an epoxy adhesive, and the movable electrode 46 is made of platinum, chromium, or copper. A spring 52 urges the printing pin 41 and the movable electrode 46 leftwardly in FIG. 5(*b*), and presses the movable electrode 46 to a stopper 47. An electrode terminal 49*a* is slidably disposed in a terminal frame 50 and urged downwardly so as to slidingly engage with the movable electrode 46 in the frame 42*a*.

A rear frame 42*b* is attached to the inside of the rear cylinder of the front frame 42*a* by means of a screw. A stationary electrode 49*b* is provided on the central axis of the rear frame 42*b*. A circumferential groove is formed in the surface of the printing pin 41, and an O-ring 51 is embedded in the groove as a packing. The O-ring 51 is made of silicone rubber. A hermetically sealed space is formed at a portion sandwiched by the O-ring 51 of the inner cylinder 43 of the front frame 42*a* and the recessed surface 42*b*′ of the rear frame 42*b*. The pressure transmitting medium 8 is sealed in the hermetically sealed space. The two electrodes 46 and 49*b* are opposed to each other along the axis of the frame 42*a* at a distance $D_3$ of 0.5 mm in the pressure transmitting medium 8.

In the printing mechanism according to the third embodiment, the length $F_{3h}$ of the combined frame including the frames 42*a* and 42*b* is 24.0 mm. The outer diameter $F_{3v}$ of the cylinder is 10.0 mm, and the inner diameter $R_{3v}$ is 8.0 mm. Additionally, the length $S_{3h}$ from the front end of the frame 42*a* to the stopper 47 is 9.0 mm. The sum length $P_{3l}$ of the printing pin 41 and the movable electrode 46 is 15.0 mm. The length $R_{3h}$ of the hermetically sealed space is 12.0 mm, and the length $R_{3h}$, of its major portion, i.e., the length from the recessed surface 42*b*′ to the stopper 47, is 8.0 mm. Furthermore, the distance $D_3$ between the ends of the electrodes 46 and 49*b* is set to 0.5 mm.

The electrodes 49*a* and 49*b* are connected to the driving circuit 20 shown in FIG. 3, the same as the first embodiment. When discharge is caused between the electrodes 46 and 49*b*, the pressure transmitting medium 8 expands. Due to this expansion, the movable electrode 46 and the printing pin 41 accept the driving pressure in the left direction in FIG. 5(*b*). Therefore, the end 41*a* projects leftwardly. The stroke of the printing pin 41 is about 0.3 to 0.5 mm.

When discharge between the electrode 46 and 49*b* stops, the internal pressure of the pressure transmitting medium 8 instantly decreases. Accordingly, the printing pin 41 and the movable electrode 46 return to their original positions at which the movable electrode 46 comes into contact with the stopper 47, by means of the restoring force of the spring 52. As in the first embodiment, the printing timing of the printing pin 41 is determined in correspondence with a control pulse applied to the terminals 18*a* and 18*b* of the driving circuit 20.

FIGS. 6(*a*), 6(*b*), and 6(*c*) show a fourth embodiment of the present invention. A front frame 62*a* is cylindrically shaped, and a bearing or bushing portion 63 is formed integrally in the inner wall of the frame 62*a*. A medium container 67 is fitted into the inside of the rear portion of the frame 62*a*. The container 67 has a bellows 67*a* at its front portion. The holding portion 63 slidably supports the bellows 67*a*. The body portion 67*b* of the container 67 is fixedly secured to the inner wall of the frame 62*a*. The container 67 is made of spring steel, phosphor spring bronze, or urethane rubber.

A movable electrode 66 is secured to the front end of the bellows 67*a* by means of an epoxy adhesive 70, which is an electrically insulating material. The central axis of the movable electrode 66 corresponds to the central axis of the bellows 67*a*. The movable electrode 66 is formed of platinum, chromium, or copper. A printing pin 61 is secured to the front end of the movable electrode 66 by means of an epoxy adhesive 65. The printing pin 61 is slidably held by a hard pin guide 64 in the lateral direction in FIG. 6(*b*).

The movable electrode 66 slidably contacts with two terminals 69*a* at its side surface. Moreover, the rear end of the movable electrode 66 extends to the inside of the bellows 67*a*.

A rear frame 62*b* is inserted into the rear portion of the medium container 67. The outer periphery of the frame 62*b* is hermetically secured to the inner wall of the container 67. The inner side of the container 67 and the recessed surface 62*b*′ of the frame 62*b* form a hermetically sealed space. The pressure transmitting medium 8 is filled in the hermetically sealed space. A fixed electrode 69*b* is secured on the central axis of the cylindrically shaped frame 62*b*. The front end of the stationary electrode 69*b* is opposed to the rear end of the movable electrode 66 at a distance $D_4$ of 0.5 mm. When the pressure transmitting medium 8 expands, the bellows 67*a* extends in the left direction in FIG. 6(*b*). The bellows 67*a* has such a restoring force as to maintain its internal capacity to a minimum.

In the printing mechanism according to the fourth embodiment, the sum length $F_{4h}$ of the frames 62*a* and 62*b* is 20.0 mm, and the outside diameter $F_{4v}$ of the frame 62*a* is 10.0 mm. The axial length $R_{4h}$ of the hermetically sealed container is 10.0 mm. The length $B_{4h}$ of the bellows 67*a* is 4.0 mm, the outer diameter $B_{4v}$ of the bellows 67*a*, 8.0 mm; the maximum inner diameter $B_{4d}$ of the bellows 67*a*, 5.0 mm, and the minimum inner diameter $B_{4d}$, of the bellows 67*a*, 3.0 mm. The axial length $P_{4l}$ combining the printing pin 61 and the movable electrode 66 is 10.0 mm.

The electrodes 69*a* and 69*b* are connected to the driving circuit 20 shown in FIG. 3, the same as the first embodiment. When discharge is caused between the electrodes 66 and 69*b*, the pressure transmitting medium 8 expands. Due to this expansion, the bellows 67*a* expands leftwardly in FIG. 6(*b*). Accordingly, the movable electrode 66 and the printing pin 61 project leftwardly. The stroke of the printing pin 61 is 0.3 to 0.5 mm.

When discharge between the electrode 66 and 69*b* stops, the internal pressure of the pressure transmitting medium 8 instantly decreases Accordingly, the printing pin 61 and the movable electrode 66 are returned to their withdrawn positions by means of the restoring force of the bellows 67*a*. The printing timing of the printing pin 61 is controlled by a control pulse applied to the terminals 18*a* and 18*b* of the driving circuit 20.

The printing mechanisms of the present invention can be used as the printing head for a line printer. In this case, a plurality of the printing mechanism are arrayed horizontally. In addition, printing mechanisms employing printing wires can be used instead of the printing pins 1*a*, 21*a*, 41*a* and 61, and the printing mechanisms can be used as a printing head for a serial printer.

Figure 7:
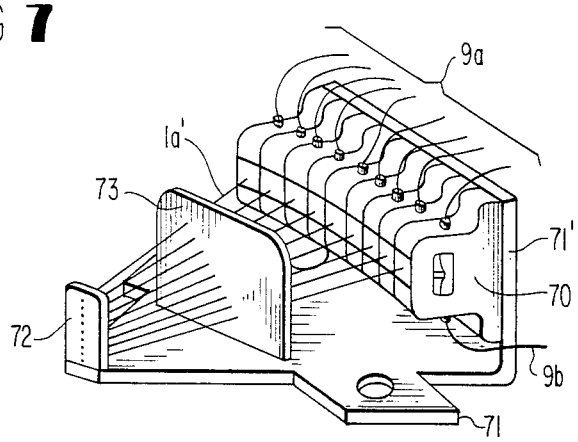
FIG. 7 is a perspective view illustrating an application of the printing mechanism shown in FIGS. 1(*a*), 1(*b*) and 1(*c*) to a printing head of a serial printer.

FIG. 7 shows an example in which printing mechanisms of the first embodiment are combined to form a printing head for a serial printer. Nine printing mechanisms 70 have printing wires 1*a*′ instead of printing pins 1*a*. The driving mechanisms 70 are provided on the side plate 71′ of a frame 71 and arranged linearly. Each driving mechanism 70 is installed such that the printing wire 1*a*′ faces a front guide 72 provided at the front end of the frame 71. The front guide 72 slidably holds the free ends of the printing wires 1*a*′. A plurality of the free ends of the printing wires 1*a*′ are arranged in a vertical row with equal spacing on the front guide 72. An intermediate guide 73 is provided between the driving mechanisms 70 and the front guide 72, and guides the intermediate portion of the printing wires 1*a*′ toward the front guide 72.

The frame 71 is mounted on a known head carrier and performs dot printing while moving in the line direction of the paper. During printing, a driving current is applied to electrodes 9*a* and 9*b* selectively at a predetermined timing.

Figure 8:
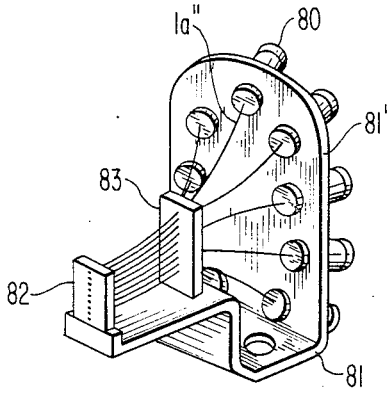
FIG. 8 is a perspective view illustrating an application of the printing mechanism shown in FIGS. 5(*a*), 5(*b*) and 5(*c*) to the printing head of a serial printer.

FIG. 8 shows an example in which the printing mechanisms of the third or fourth embodiments shown in FIG. 5(*a*) or FIG. 6(*a*) are applied to the printing head of a serial printer. Each of a plurality of driving mechanisms 80 has a printing wire 1*a*″ instead of the printing pin 41*a* or 61. Each driving mechanism 80 is installed on the side plate 81′ of a frame 81 of a circular shape. A front guide 82 is provided at the front end of the frame 81. The front guide 82 is disposed at a position substantially equally distant from each driving mechanism 80. Each driving mechanism 80 is installed such that the printing wire 1*a*″ faces an intermediate guide 83. A plurality of printing wires 1*a*″ are arranged in a vertical row with equal spacing in the intermediate guide 83, and their free ends are slidably held by the front guide 82. The frame 81 is installed on a known head carrier, and performs dot printing while moving in the line direction of the paper.

As described above, the printing mechanism of the present invention drives the printing pins by making use of the expansion of the pressure transmitting medium in the hermetically sealed container. Accordingly, a compact and lightweight printing mechanism can be obtained, which can perform high-speed printing. Furthermore, the driving energy for the printing mechanism can greatly reduced.

What is claimed is:

1. A printing mechanism comprising:

a printing element having an impacting surface at its front end and a driven surface at its rear end;

a holder for slidably supporting said printing element, said holder having a hollow portion located to the rear of said printing element, said hollow portion having rigid inner walls except at a front portion which faces said rear end of said printing element;

a hermetically sealed container having an elastic wall portion;

a pressure transmitting medium contained in said hermetically sealed container; and driving means provided inside said hermetically sealed container for expanding said pressure transmitting medium;

said hermetically sealed container with said pressure transmitting medium and said driving means situated therein being located within said hollow portion of said holder such that said elastic wall portion is positioned at said front portion of said hollow portion to contact said rear end of said printing element;

whereby the expansion of said pressure transmitting medium by said driving means is concentrated at said elastic wall portion, to move said elastic wall portion to drive said printing element.

2. The printing mechanism as claimed in claim 1, wherein said hermetically sealed container includes an elastic tube, said elastic wall portion being formed at the central portion of said tube.

3. The printing mechanism as claimed in claim 2, wherein a wall thickness of said elastic wall portion of said tube is thinner than that of other portions of said tube.

4. The printing mechanism as claimed in claim 1, wherein said elastic member includes a bellows, the front end of said bellows contacting said rear end of said printing element.

5. The printing mechanism as claimed in claim 1, wherein said driving means includes two electrodes having a predetermined spacing, said pressure transmitting medium being expanded by a discharge caused between said two electrodes.

6. The printing mechanism as claimed in claim 5, wherein said two electrodes are located at fixed positions in said hermetically sealed container.

7. The printing mechanism as claimed in claim 1, wherein said pressure transmitting medium is a liquid or gas having electrical insulating properties

8. The printing mechanism as claimed in claim 1, further comprising biasing means for pressing said printing element against said hermetically sealed container.

9. The printing mechanism as claimed in claim 8, wherein said biasing means comprises a bellows formed integrally with said hermetically sealed container.

10. The printing mechanism as claimed in claim 5, wherein said driving means further comprises means for applying a high voltage across said electrodes, including capacitor means for holding a predetermined charge and switching means triggered by a control signal for connecting said capacitor in circuit with said electrodes.

11. A printing mechanism comprising:

a printing element having an impacting surface at its front end and a driven portion at its rear end;

a holder for slidably supporting said printing element;

a hermetically sealed container including a bellows capable of expansion and contraction in accordance with a volumetric change in the content of said container, the front end of said bellows contacting said rear end of said printing element;

a pressure transmitting medium contained in said hermetically sealed container and comprising the content of said container; and driving means provided at least partially inside said hermetically sealed container for expanding said pressure transmitting medium.

12. The printing mechanism as claimed in claim 11, wherein said hermetically sealed container comprises a front frame integral with said holder and a rear frame hermetically fixed to the inner wall of said front frame.

13. The printing mechanism as claimed in claim 14 wherein said two electrodes include a movable electrode formed integrally with said printing element and a fixed electrode fixedly disposed in said hermetically sealed container.

14. The printing mechanism as claimed in claim 11, wherein said driving means includes two electrodes having a predetermined spacing, said pressure transmitting medium being expanded by a discharge caused between said two electrodes.

15. The printing mechanism as claimed in claim 11, wherein said pressure transmitting medium is a liquid or gas having electrical insulating properties.

16. The printing mechanism as claimed in claim 11, further comprising biasing means for pressing said printing element against said hermetically sealed container.

17. The printing mechanism as claimed in claim 14, wherein said driving means further comprises means for applying a high voltage across said electrodes, including capacitor means for holding a predetermined charge and switching means triggered by a control signal for connecting said capacitor in circuit with said electrodes.

18. a printing mechanism comprising:

a printing element having an impacting surface at its front end;

a movable electrode having a thick portion integral with a rear end of said printing element and a thin portion projected to the rear of said thick portion;

a holder for slidably supporting said thick portion of said movable electrode;

a hermetically sealed housing coupled with said holder, said movable electrode constituting a portion of an inner wall of said hermetically sealed housing, said thin portion of said movable electrode being located within said hermetically sealed housing;

a fixed electrode fixedly disposed within said hermetically sealed housing so as to face said thin portion of said movable electrode;

drive means for supplying a voltage between said movable electrode and said fixed electrode; and a pressure transmitting medium contained in said hermetically sealed housing;

a discharge caused between said thin portion of said movable electrode and said fixed electrode by said drive means acting to expand said pressure transmitting medium in said hermetically sealed housing to slide said thick portion of said movable electrode, and as a result said printing element, in a forward direction in accordance with a volumetic change of said pressure transmitting medium.

19. The printing mechanism as claimed in claim 18, wherein said pressure transmitting medium is a liquid or gas having electrical insulating properties.

20. The printing mechanism as claimed in claim 18, further comprising biasing means for pressing said printing element against said hermetically sealed housing.

21. The printing mechanism as claimed in claim 18, wherein said driving means includes capacitor means for holding a predetermined charge and switching means triggered by a control signal for connecting said capacitor in circuit with said electrodes.

22. A dot impact-type printing head for a serial printer comprising:

a plurality of printing mechanisms each including a printing wire having an impacting surface at its front end and a driven surface at its rear end; a holder for slidably supporting each said printing wire, said holder having a hollow portion located to the rear of said printing element, said hollow portion having rigid inner walls except at a front portion which faces said rear end of said printing element; a hermetically sealed container having a elastic wall portion; a pressure transmitting medium contained in said hermetically sealed container; and driving means provided inside said hermetically sealed container, said driving means comprising means for expanding said pressure transmitting medium; said hermetically sealed container being arranged inside said hollow portion of said holder such that said elastic wall portion contacts said rear end of said printing wire, said elastic wall portion being capable of expansion and contraction in a forward and rearward direction in accordance with a volumetic change of said pressure transmitting medium, whereby the expansion of said hermetically sealed container is concentrated at said elastic wall portion to drive said printing wire;

a frame for supporting said printing mechanisms such that each of said plurality of printing mechanisms faces substantially the same point; and guide means for slidably supporting said front ends of said printing wires, said front ends of said printing wires being arrayed in a row with uniform spacing therebetween.

23. A dot impact-type printing head for a serial printer comprising:

a plurality of printing mechanisms each including a printing wire having an impacting surface at its front end and a driven portion at its rear end; a holder for slidably supporting said printing wire; a hermetically sealed container including a bellows capable of expansion and contraction in accordance with a volumetic change in the content of said container, the front end of said bellows contacting said rear end of said printing wire; a pressure transmitting medium contained in said hermetically sealed container; and driving means provided at least partially inside said hermetically sealed container, said driving means comprising means for expanding said pressure transmitting medium;

a frame for supporting said printing mechanisms such that each of said plurality of said printing mechanisms faces substantially the same point; and guide means for slidably supporting said front ends of said printing wires, said front ends of said printing wires being arrayed in a row with uniform spacing therebetween.

24. A dot impact-type printing head for a serial printer comprising:

a plurality of printing mechanisms each including a printing wire having an impacting surface at its front end and a driven surface at its rear end; a holder for slidably supporting said printing wire; a movable electrode integrally secured to said rear end of said printing wire; a hermetically sealed container formed to the rear of said printing wire, inner walls of said hermetically sealed container including said rear end of said printing wire such that said movable electrode is located in said hermetically sealed container, a fixed elctrode fixedly disposed in said hermetically sealed container so as to face said movable electrode; drive means for supplying a voltage across said movable and fixed electrodes; and a pressure transmitting medium contained in said hermetically sealed container; said pressure transmitting medium being expanded in said hermetically sealed container by a discharge caused between said movable and fixed electrodes whereby said printing wire slides in a forward direction in accordance with a positive volumetic change of said pressure transmitting medium;

a frame for supporting said printing mechanisms such that each of said plurality of said printing mechanisms faces substantially the same point; and guide means for slidably supporting said front ends of said printing wires, said front ends of said printing wires being arrayed in a row with uniform spacing therebetween.

* * * * *

UNITED STATES PATENT AND TRADEMARK OFFICE

CERTIFICATE OF CORRECTION

PATENT NO. : 4,613,241

DATED : September 23, 1986

INVENTOR(S) : Kunio Kitagawa

It is certified that error appears in the above-identified patent and that said Letters Patent is hereby corrected as shown below:

Column 6, line 16, before "spring" insert --stainless-.

Column 7, line 1, after "decreases" insert --.--.

Column 7, line 25, after "spacing" delete "on" and insert --in--.

Claim 24, column 11, line 4, delete "elctrode" insert --electrode--.

Signed and Sealed this

Thirty-first Day of March, 1987

*Attest:*

*Attesting Officer*

DONALD J. QUIGG

*Commissioner of Patents and Trademarks*